US006211611B1

(12) United States Patent
Taguchi et al.

(10) Patent No.: US 6,211,611 B1
(45) Date of Patent: Apr. 3, 2001

(54) COLOR CATHODE-RAY TUBE WITH RESISTIVE SPRING CONTACT

(75) Inventors: Yuji Taguchi, Kyoto; Hideharu Ohmae, Toyonaka, both of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/143,775

(22) Filed: Aug. 31, 1998

(30) Foreign Application Priority Data

Oct. 13, 1997 (JP) ..... 9-278391

(51) Int. Cl.[7] ..... H01J 29/88; H01J 29/96
(52) U.S. Cl. ..... 313/456; 313/479; 313/477 HC
(58) Field of Search ..... 313/479, 481, 313/482, 477 HC, 456; 315/3

(56) References Cited

U.S. PATENT DOCUMENTS 3,882,348 * 5/1975 Paridaens ..... 315/3
4,255,689 * 3/1981 Fischman et al. ..... 315/3

FOREIGN PATENT DOCUMENTS 55-1010 * 1/1980 (JP) ..... H01J/29/88
55-151754 * 11/1980 (JP) ..... H01J/29/88
59-171439 * 9/1984 (JP) ..... H01J/29/88
61-131341 * 6/1986 (JP) ..... H01J/29/48

OTHER PUBLICATIONS

T.A. Giorgi, Getters and Gettering, Japan J. Appl. Phys. Suppl. 2, Pt. 1 pp. 53–60, 1974 (No Month).*

* cited by examiner

*Primary Examiner*—Michael H. Day
(74) *Attorney, Agent, or Firm*—Merchant & Gould P.C.

(57) ABSTRACT

A cathode-ray tube comprises a bulb formed by connecting a panel having a phosphor provided on the inner surface and a funnel having a conductive coating film provided on the inner wall, an electron gun housed in the neck portion of the funnel, and springs that are provided for a final electrode of the electron gun. The springs have contact portions to electrically contact the coating film on the funnel inner wall and the final electrode, in which the specific resistance value of the contact portions of the springs is determined to be greater than that of the graphite coating film contacting with the contact portions. As only one kind of conductive coating film need be applied, the production process can be simplified compared to the case for using plural kinds of coating films, and problems in connecting the junctions of the coating films can be also resolved. Furthermore, the maximum instantaneous current generated at a discharge inside the bulb can be reduced, and thus, malfunction or breakage of the circuit parts of a TV set can be prevented.

10 Claims, 7 Drawing Sheets

COLOR CATHODE-RAY TUBE WITH RESISTIVE SPRING CONTACT

FIELD OF THE INVENTION

This invention relates to a cathode-ray tube used as a receiving set of television, a computer display, and so on.

BACKGROUND OF THE INVENTION

In a general cathode-ray tube, a high resistivity film is provided at the midpoint of a feed line from an anode provided for a funnel to an anode of an electron gun in order to lower the maximum instantaneous current at sparking inside a bulb, and to prevent the current from damaging the electron circuit connected to the electron gun, or the like. More specifically, as shown in FIG. 7, a conventional cathode-ray tube comprises a bulb 6 comprising a panel 2 having a phosphor 1 provided on the inner surface and a funnel 5 having conductive films 4*a*, 4*b*, and 4*c* provided on the inner wall 3, an electron gun 7 housed in a neck portion 5*a* of the funnel 5, and springs 10 having contact portions 9 to electrically connect the conductive film 4*a* on the funnel inner wall 3 with a final electrode 8. Numeral 24 indicates an anode terminal which applies high voltage to the final electrode 8 of the electron gun 7 through the conductive films 4*a*, 4*b*, and 4*c*.

The specific resistance value of the conductive film 4*a* at the neck portion 5*a* is set to be 0.1–1 Ωcm, the specific resistance value of the conductive film 4*b* at the cone portion 5*b* is set to be no more than 0.1 Ωcm, and the specific resistance value of the conductive film 4*c* between the conductive film 4*a* at the neck portion 5*a* and the conductive film 4*b* at the cone portion 5*b* is set to be 1–10 Ωcm respectively. The contact portions 9 of the springs 10 to contact with the conductive film 4*a* at the neck portion 5*a* are made of a metallic material having high conductivity, such as stainless steel. The above-mentioned construction lowers the maximum instantaneous current generated at a discharge inside the bulb 6, and protects the circuit parts of a TV set from malfunction or breakage (Tokkai Sho 59-171439).

In such a cathode-ray tube, however, the conductive films (4*a*, 4*b*, 4*c*) made of different materials are respectively formed on the funnel inner wall 3, so the cathode-ray tube has problems in connection, such as conductivity failures at the junction A between the conductive films 4*a* and 4*c*, and the junction B between the conductive films 4*b* and 4*c*, and stripping of the coating film. Another problem is the complicated production process since the different kinds of conductive films (4*a*, 4*b*, 4*c*) are respectively formed in a wide range at predetermined regions having different shapes on the inner wall 3 of the funnel 5.

SUMMARY OF THE INVENTION

The object of this invention is to provide a cathode-ray tube that solves the problems in connecting different kinds of conductive films at the junctions and that simplifies the production process.

A cathode-ray tube of this invention comprises a bulb having a panel provided with a phosphor on the inner surface and a funnel having a conductive film provided on the inner wall, an electron gun housed in the neck portion of the funnel, and a spring that is provided for the final electrode of the electron gun and has a contact portion to electrically connect the conductive film on the funnel inner wall with the final electrode, in which the spring has a part with a specific resistance value greater than that of the conductive film that contacts with the contact portion at the mid-point of the conductive path between the conductive film and the final electrode.

As a result, only one kind of conductive film is applied to the funnel inner wall, which resolves the problem of the conventional cathode-ray tube, that is, the problem in the junction of different kinds of conductive films, and the production process can be simplified. Moreover, the maximum instantaneous current at a discharge inside the bulb can be lowered since the part in the spring composing the conductive path at a discharge has a specific resistance value greater than that of the conductive film that contacts with the contact portion. Therefore, malfunction and breakage of the circuit parts of a TV set can be prevented.

It is preferable that the portion housing a getter is formed between the phosphor on the inner surface of the panel and the final electrode of the electron gun.

This preferable constitution allows a getter flash, and thus, the vacuum level inside the bulb can be improved. Moreover, the entire specific resistance value of the conductive path will not be lowered at a discharge even if the getter adheres to the conductive film on the funnel inner wall at the getter flash so that the specific resistance value of the conductive film is lowered, since the part in the spring has the specific resistance value greater than that of the conductive film that contacts with the contact portion. Therefore, the maximum instantaneous current generated at a discharge inside the bulb can be maintained at a low value even after the getter flash.

DETAILED DESCRIPTION OF THE INVENTION

Figure 1:
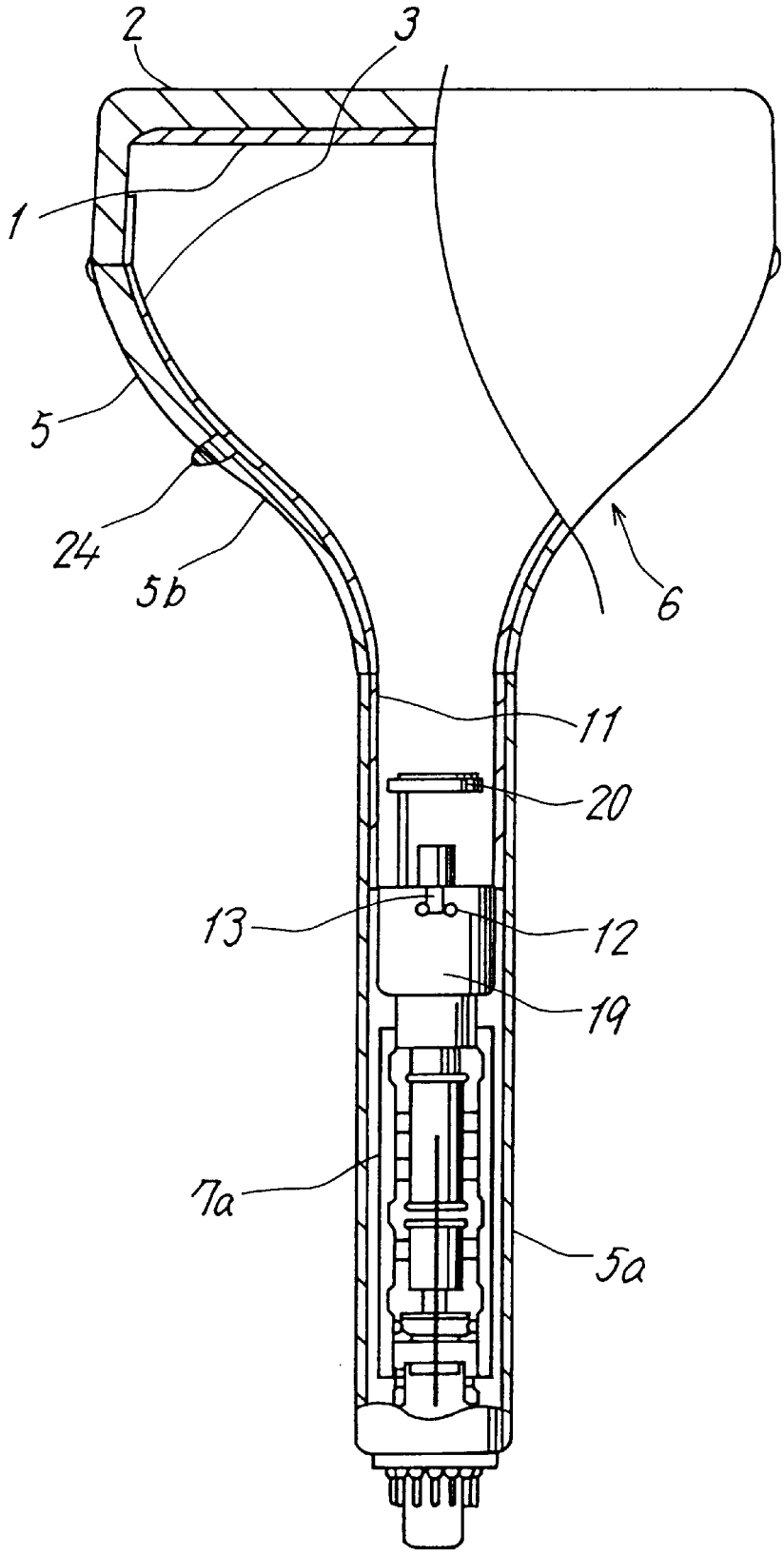
FIG. 1 is a cross-sectional view illustrating a cathode-ray tube in a first embodiment of this invention.

The embodiment of this invention will be explained below referring to the drawings.

As shown in FIG. 1, a cathode-ray tube in a first embodiment of this invention is used for a projection tube, and it comprises a bulb 6 comprising a panel 2 and a funnel 5, an electron gun 7*a* to emit electron beams, springs 13, and an anode terminal 24. The panel 2 has a phosphor 1 provided on the inner surface and the funnel 5 has on its inner wall 3 a conductive film 11 with a specific resistance value of about 0.5 Ωcm, mainly containing graphite and titanium oxide. The electron gun 7*a* is housed in a neck portion 5*a* of the funnel 5. The springs 13 are provided for the final electrode 19 of the electron gun 7*a* and have contact portions 12 to electrically connect the conductive film 11 on the funnel inner wall 3 with the final electrode 19. And the anode terminal 24 is provided to a cone portion 5*b* of the funnel 5, and applies high voltage to the final electrode 19 of the electron gun 7*a* through the conductive film 11.

Figure 2:
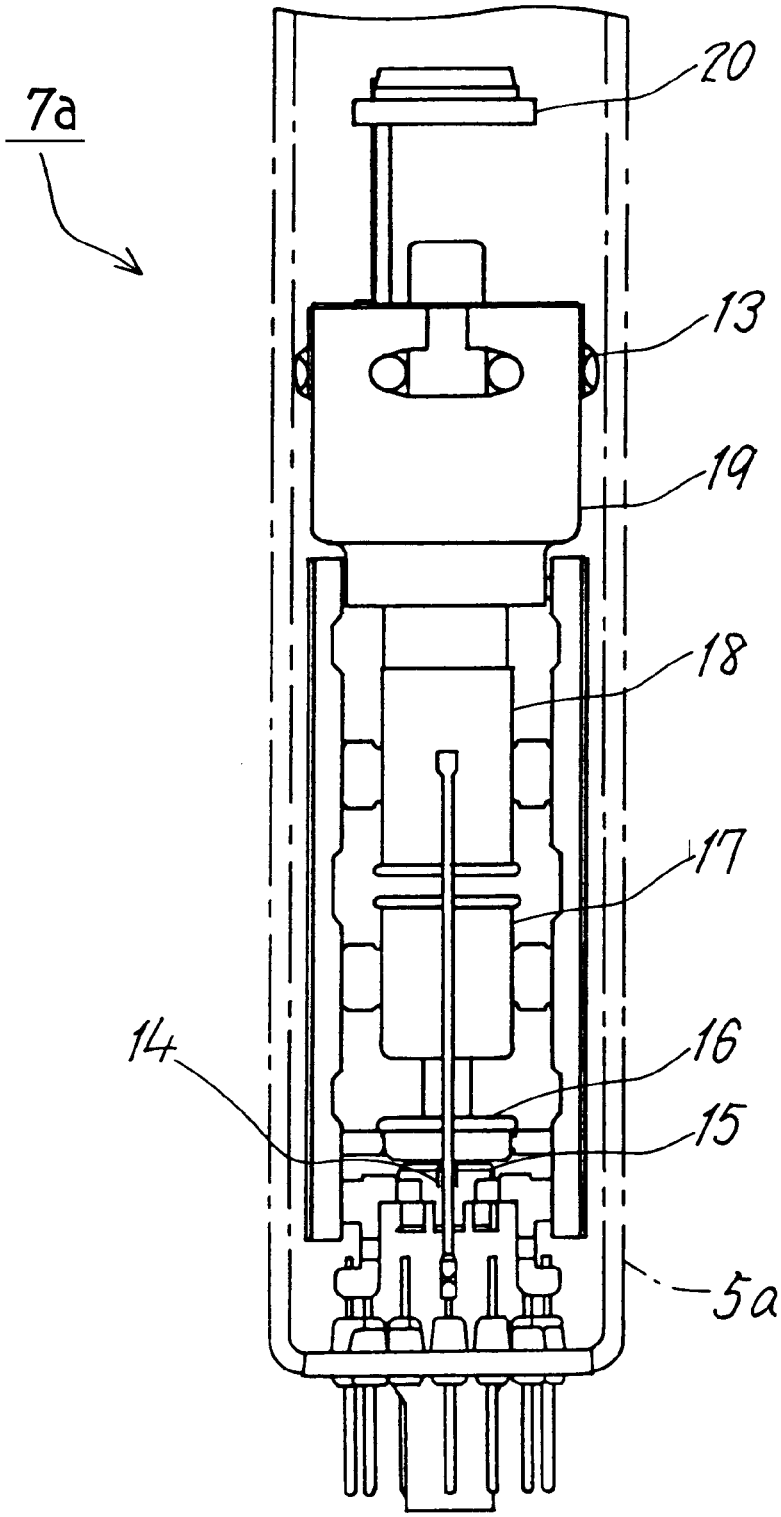
FIG. 2 is a magnified view illustrating an electron gun in the neck portion of the cathode-ray tube in the first embodiment of this invention.

As shown in FIG. 2, the electron gun 7*a* comprises a cathode 14, a control electrode 15, an accelerating electrode 16, an anodic electrode 17, a focusing electrode 18, a final electrode 19 and a getter shielding cylinder 20, which are sequentially arranged in the direction of emission of electron beams.

Figure 3:
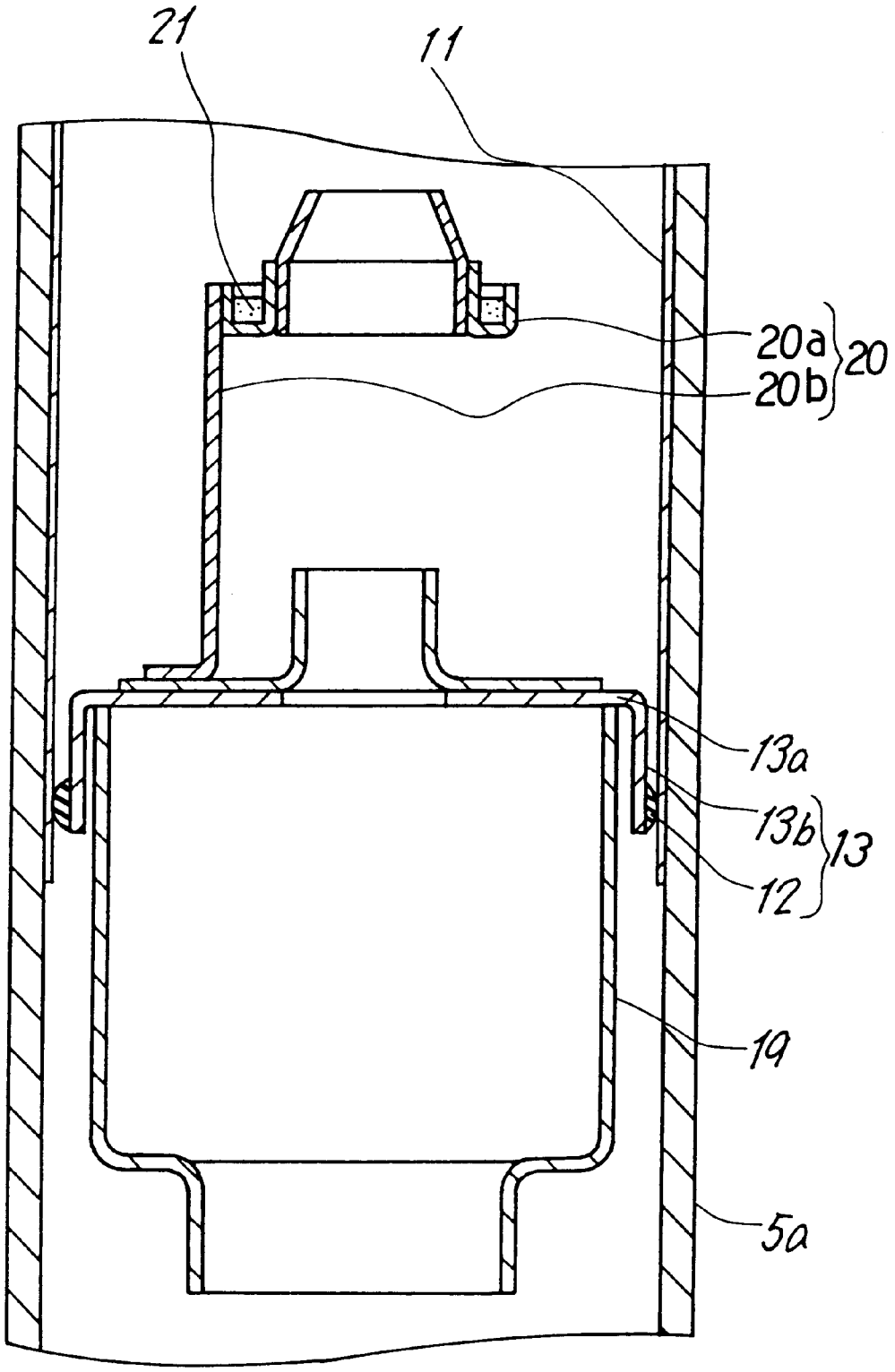
FIG. 3 is a magnified cross-sectional view illustrating the spring portions of the cathode-ray tube in the first embodiment of this invention.
Figure 4:
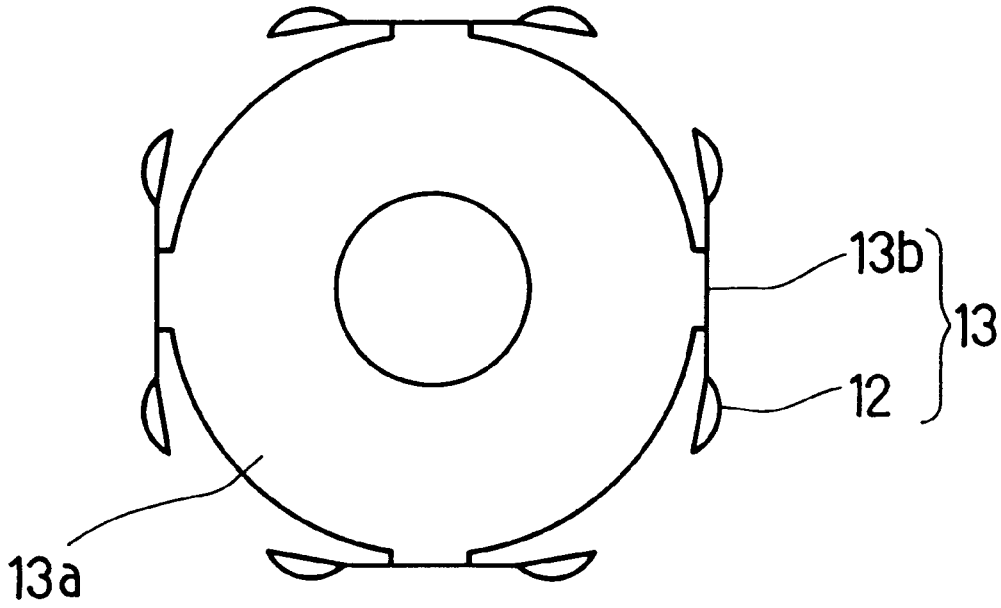
FIG. 4 is a plan view illustrating the springs of the cathode-ray tube in the first embodiment of this invention.
Figure 5:
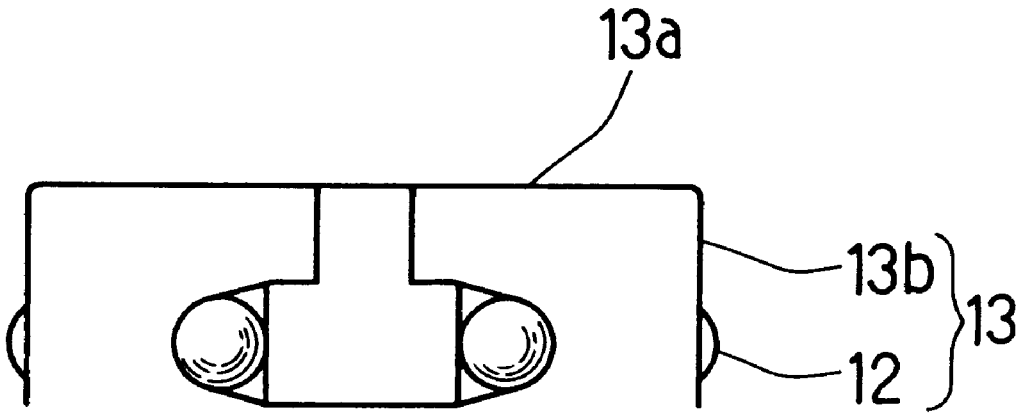
FIG. 5 is a front view illustrating the springs of the cathode-ray tube in the first embodiment of this invention.

As shown in FIGS. 3–5, a plurality of the springs 13 are formed at the periphery of a disk metallic plate 13*a* comprising stainless steel whose diameter is the same as the outer diameter of the final electrode 19. Each spring 13 comprises an elastic arm portion 13*b* comprising stainless steel provided in the direction perpendicular to the surface of the metallic plate 13*a*, and a contact portion 12 containing ceramics or paste-like high resistance agents or the like that is formed at the free edge of the elastic arm portion 13*b*. The springs 13 are arranged by covering the final electrode 19 with the metallic plate 13*a* and fixing the metallic plate 13*a* to the final electrode 19 through welding or an epoxy-based conductive adhesives in which silver particles are dispersed. The specific resistance value of the contact portions 12 of the springs 13 ranges preferably from 1 to $10^4$ Ωcm, and the value is greater than the specific resistance value of the conductive film 11 that contacts with the contact portions 12. It is specifically preferable that the specific resistance value of the contact portions 12 ranges from 100 to $10^4$ Ωcm, when considering the decrease of the maximum instantaneous current generated at a discharge inside the bulb 6.

As shown in FIG. 3, the getter shielding cylinder 20 comprises a housing portion 20*a* and a getter column 20*b*. The housing portion 20*a* houses a getter 21 provided between the phosphor 1 on the inner surface of the panel 2 and the final electrode 19 of the electron gun 7*a*. The getter column 20*b* is fixed to the metallic plate 13*a* by welding and holds the housing portion 20*a*. The getter 21, which improves the vacuum level inside the bulb 6, comprises barium materials or the like.

The effects of the above embodiment of this invention will be explained below.

Figure 7:
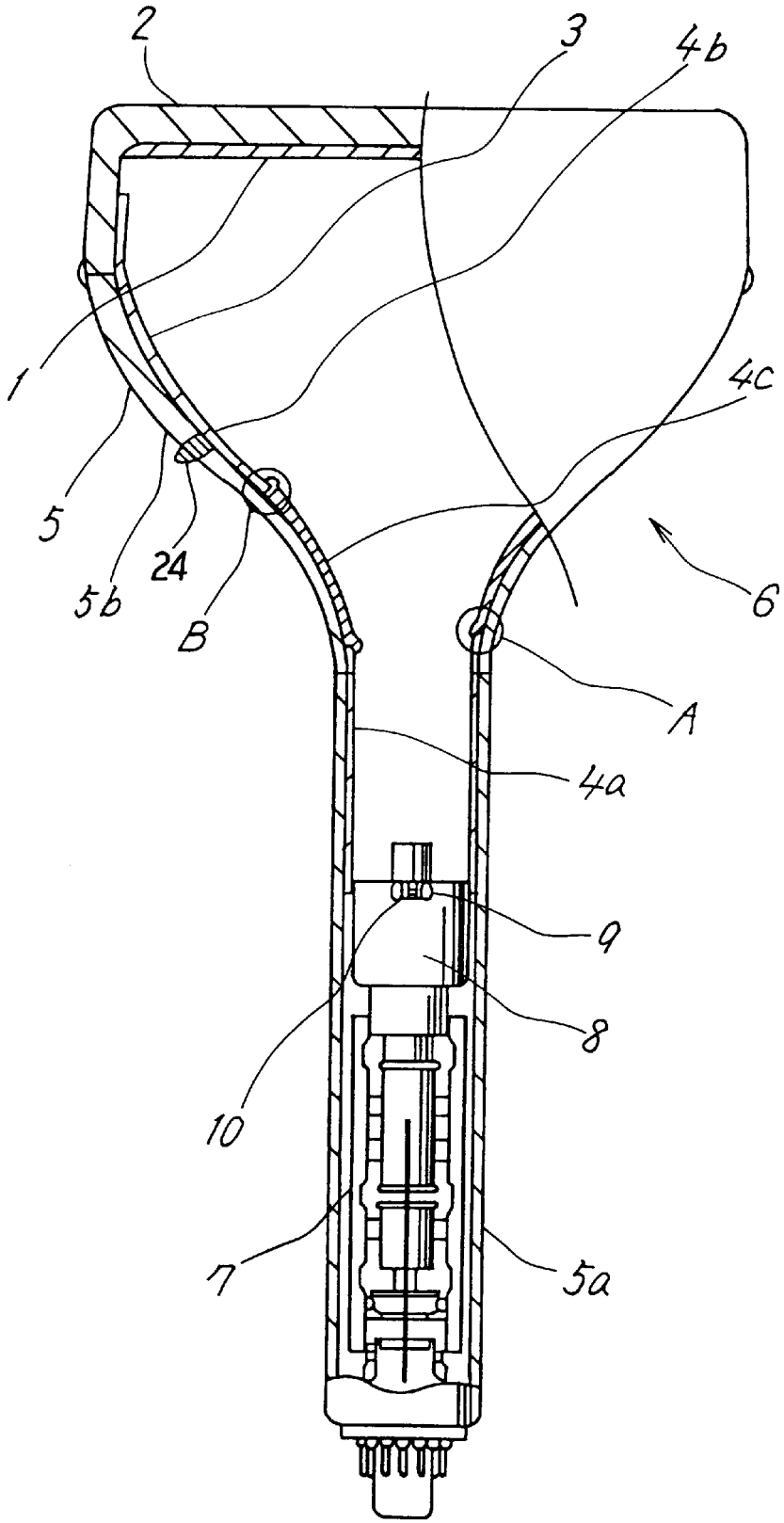
FIG. 7 PRIOR ART
FIG. 7 is a cross-sectional view illustrating a conventional cathode-ray tube.

In a cathode-ray tube of the first embodiment of this invention, the specific resistance value of the contact portions 12 of the springs 13 is greater than that of the conductive film 11 that contacts with the contact portions 12, so that only one kind of conductive film 11 is formed on the funnel inner wall 3, and the maximum instantaneous current generated at a discharge inside the bulb 6 can be lowered. In other words, the cathode-ray tube of the first embodiment of this invention comprising a kind of conductive film 11 formed continuously with a uniform composition on the funnel inner wall 3 can resolve the problems in connecting different kinds of conductive films in a conventional cathode-ray tube in which three kinds of conductive films (4*a*, 4*b* and 4*c*) are formed on the funnel inner wall 3 as shown in FIG. 7. In addition, the production process can be simplified because of the reduction of number of the production steps. Moreover, the maximum instantaneous current to be generated is lowered because the contact portions in the conductive path at a discharge inside the bulb 6 have a relatively great specific resistance value. As a result, malfunction and breakage, or some other problems for the circuit parts of a TV set can be prevented even for a projection tube that operates at a high anodic voltage of at least 30 kV.

Since the housing portion 20*a* housing the getter 21 is provided between the phosphor 1 on the inner surface of the panel 2 and the final electrode 19 of the electron gun 7*a*, the vacuum level inside the bulb 6 can be improved by carrying out a getter flash to evaporate barium. Furthermore, the maximum instantaneous current generated at a discharge can be maintained at a low value even if the getter 21 adheres to the conductive film 11 on the funnel inner wall at the getter flash and the specific resistance value of the conductive film 11 is lowered, since the contact portions 12 with a great and constant specific resistance value are contained in the springs 13 partially composing the discharge path at discharge inside the bulb 6. As a result, malfunction and breakage, or some other problems for the circuit parts of a TV set can be prevented.

The maximum instantaneous current generated at a discharge inside the bulb 6 can be lowered over time since ceramic materials with high abrasion resistance and stable specific resistance value are used for the contact portions 12 of the springs 13. Also, the portions can be produced in a simple manner as the ceramic materials are formed at a small area of each contact portion 12.

As the plural elastic arm portions 13*b* of the springs 13 are provided at the periphery of the metallic plate 13*a* in the direction perpendicular (axial direction of the tube) to the surface of the metallic plate 13*a*, the elastic force can be finely adjusted by the aim length of the elastic arm portions 13*b*. As a result, damage to the conductive film 11 on the funnel inner wall 3, which is caused by the stress from the contact portions 12 of the elastic arm portions 13*b*, can be reduced at the time of insertion of the electron gun into the neck portion 5*a* of the funnel 5. This can also reduce sparks between the electrodes, which are caused by foreign materials that are formed from the stripped conductive film 11.

In the above-mentioned embodiment shown in FIGS. 1–5, the metallic plate 13*a* and the elastic arm portions 13*b* are integrated by using stainless steel, and contact portions 12 are formed by using ceramic materials at the ends of the elastic arm portions 13*b*. The springs of this invention are, however not limited to the embodiment, but it is also possible that the elastic arm portions 13*b* and contact portions 12 are formed by using ceramic materials and connected with the metallic plate 13*a*. Or all the disk metallic plate 13*a*, elastic arm portions 13*b* and the contact portions 12 can be formed with ceramic materials, and arranged by electrically connecting with the final electrode 19. By preparing not only the contact portions 12 but the metallic plates 13*a* or the like with ceramic materials, more portions in the conductive path at a discharge are made of ceramics having greater specific resistance value, so the maximum instantaneous current can be lowered more remarkably. In general, the resistance at the contact portions of ceramic materials is about 1 MΩ. When the elastic arm portions 13*b* are made of ceramic materials, the general resistance value ranges from 2 to 5M Ω. Therefore, if the maximum instantaneous current cannot be lowered sufficiently by forming only the contact portions 12 with ceramic materials, the elastic arm portions 13*b* serially connected to the contact portions 12 also can be formed with ceramic materials, so that the maximum instantaneous current can be further lowered. At that time, the specific resistance value of the elastic arm portions 13*b* made of ceramic materials is preferably ranging from 1 to $10^4$ Ω.

When forming the elastic arm portions 13*b* with ceramic materials, applicable ceramic materials include, for instance, zirconia-based ceramics (normal Young's modulus is about $2–3\times10^{10}(N/m^2)$) and silicon nitride-based ceramics (normal Young's modulus is about $3\times10^{10}(N/m^2)$). In order to provide a suitable material for a spring, the Young's modulus is raised to $5–30\times10^{10}(N/m^2)$ by properly adjusting the composition ratio of these ceramic materials before forming the materials into a spring of a desired shape. The arm length of the elastic arm portions 13*b* (In FIG. 5, the half length between the centers of two contact portions 12 contained in a sprino 13) ranges from about 3 mm to about 5 mm, though it can be properly determined depending on some factors such as the size of the cathode-ray tube.

EXAMPLE 1

The following explanation is about this Example describing the effects of his invention.

A cathode-ray tube of this invention has the construction as shown in FIGS. 1 and 2, comprising a unipotential type electron gun 7*a* for the neck with diameter of ϕ29.1 mm as shown in FIG. 2, where the specific resistance value of the conductive film 11 on the funnel inner wall 3 is 0.5 Ωcm, formed with ceramic materials so that the specific resistance value of the contact portions 12 of the springs 13 is 55 Ωcm.

For comparison, another cathode-ray tube is also produced in the same manner, except that the contact portions 12 of the springs 13 are formed with stainless steel (SUS304) whose specific resistance value is $7.5\times10^{-5}$ Ωcm.

Figure 6:
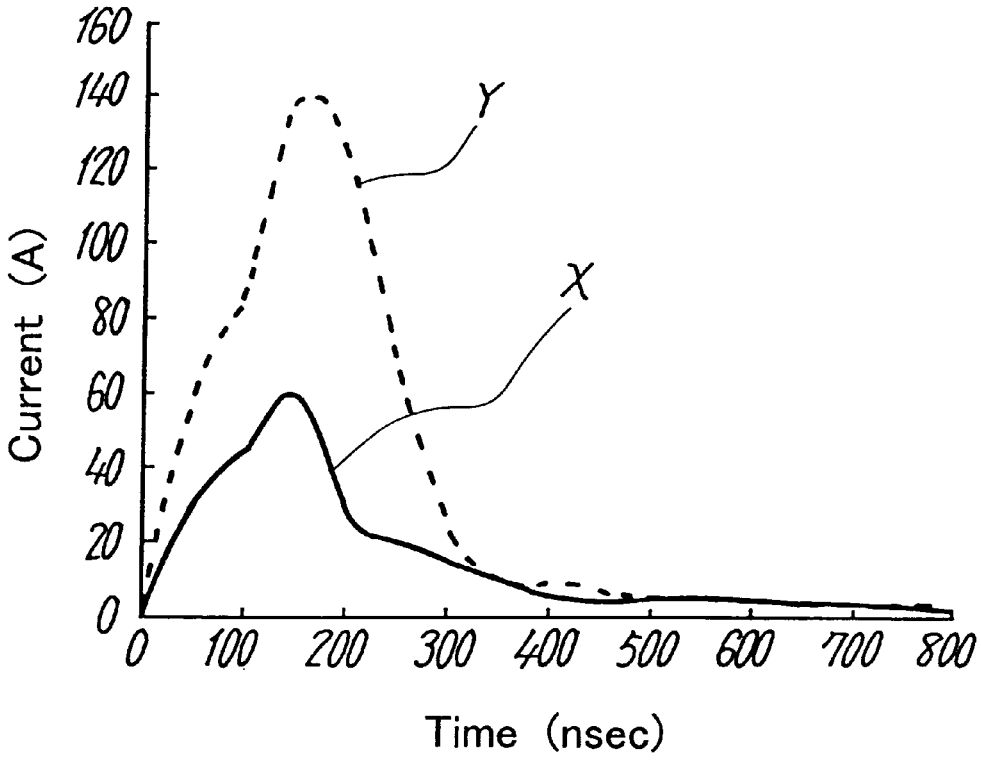
FIG. 6 is a graph illustrating the maximum instantaneous current flowing at a discharge inside the bulb of a cathode-ray tube of this invention and that of another cathode-ray tube for comparison.

The maximum instantaneous current flowing at a discharge inside the bulb was examined by using a method mentioned below. In the examination, the potential of the anodic electrode 17 and the final electrode 19 applied through the anode 24 was determined to be 32 kV, and the other electrodes than these two electrodes (17 and 19) were determined as the ground potentials. The discharge inside the bulb was artificially generated by irradiating laser beams between the accelerating electrode 16 and the focusing electrode 18. The maximum instantaneous current was measured with a storage tube oscilloscope by using a current probe. The result is shown in FIG. 6. The curves X and Y in FIG. 6 respectively indicate the cathode-ray tube of this invention and another cathode-ray tube for comparison.

In the cathode-ray tube of his invention, the maximum instantaneous current at a discharge inside the tube was 60A, namely, it decreased to 43% in comparison with the other cathode-ray tube whose maximum instantaneous current was 140A.

This invention is not limited to the above-mentioned projection tube having a unipotential type electron gun for neck with a diameter of ϕ29.1 mm, but similar effects can be obtained by using projection tubes having a unipotential type electron gun for neck with a diameter of ϕ36.5 mm, an electromagnetic focusing type electron gun or bipotential type electron gun; monochrome cathoderay tubes, color cathode-ray tubes, and so on.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A cathode-ray tube comprising a bulb having a panel with a phosphor provided on the inner surface and having a funnel with a conductive film provided on the inner wall, an electron gun housed in the neck portion of the funnel, and a spring provided for a final electrode in the electron gun and electrically connecting the conductive film on the funnel inner wall with the final electrode; wherein the spring comprises an elastic arm portion formed at the periphery of the final electrode and a contact portion formed at the free edge of the elastic arm portion and at least either the elastic arm portion or the contact portion comprises a part having a specific resistance value greater than that of the conductive film.

2. The cathode-ray tube according to claim 1, wherein a housing portion that houses a getter is provided between the phosphor on the inner surface of the panel and the final electrode of the electron gun.

3. The cathode-ray tube according to claim 1, wherein a plurality of the springs are formed at the periphery of a disk metallic plate being arranged by covering a panel-side opening of the final electrode with the metallic plate and by fixing the metallic plate to the final electrode.

4. The cathode-ray tube according to claim 1, wherein at least one part of the spring comprises ceramics.

5. The cathode-ray tube according to claim 1, wherein the specific resistance value of the part of the spring that is greater than that of the conductive film ranges from 1 to $10^4$ Ωcm.

6. The cathode-ray tube according to claim 1, wherein an anode terminal is provided to the funnel, and the conductive film forms a conductive path to electrically connect the anode terminal with the final electrode.

7. The cathode-ray tube according to claim 6, wherein the conductive film.

8. The cathode-ray tube according to claim 6, wherein the conductive film between the anode terminal and the final electrode comprises a uniform composition.

9. A cathode-ray tube comprising a bulb having a panel with a phosphor provided on the inner surface and having a funnel with a conductive film provided on the inner wall, an electron gun housed in the neck portion of the funnel, and a spring provided for a final electrode in the electron gun and having a contact portion to electrically connect the conductive film on the funnel inner wall with the final electrode; the spring comprises a part having a specific resistance value greater than that of the conductive film that contacts with the contact portion at the mid-point of the conductive path between the conductive film and the final electrode; and the contact portion of the spring comprises ceramics.

10. A cathode-ray tube comprising a bulb having a panel with a phosphor provided on the inner surface and having a funnel with a conductive film provided on the inner wall, an electron gun housed in the neck portion of the funnel, and a spring provided for a final electrode in the electron gun and having a contact portion to electrically connect the conductive film on the funnel inner wall with the final electrode; the spring comprises a part having a specific resistance value greater than that of the conductive film that contacts with the contact portion at the mid-point of the conductive path between the conductive film and the final electrode; and the specific resistance value of the contact portion of the spring ranges from 1 to $10^4$ Ωcm.

* * * * *